US005257032A

United States Patent [19]

Diamond et al.

[11] Patent Number: 5,257,032

[45] Date of Patent: Oct. 26, 1993

[54] ANTENNA SYSTEM INCLUDING SPIRAL ANTENNA AND DIPOLE OR MONOPOLE ANTENNA

[75] Inventors: James A. Diamond, Harrison, N.Y.; Maurice Diamond, Sharon, Mass.

[73] Assignee: RDI Electronics, Inc., New Rochelle, N.Y.

[21] Appl. No.: 938,321

[22] Filed: Aug. 31, 1992

Related U.S. Application Data

[63] Continuation of Ser. No. 645,585, Jan., 1991, abandoned.

[51] Int. Cl.[5] ..... H01Q 1/36; H01Q 1/00

[52] U.S. Cl. ..... 343/730; 343/727; 343/895

[58] Field of Search ..... 343/730, 725, 805, 793, 343/893, 895, 727

[56] References Cited

U.S. PATENT DOCUMENTS

| | | | |
|---|---|---|---|
| 2,935,746 | 5/1960 | Marston et al. | 343/761 |
| 3,039,099 | 6/1962 | Chait et al. | 343/851 |
| 3,683,392 | 8/1972 | White | 343/805 |
| 3,820,117 | 6/1974 | Hall et al. | 343/895 |
| 4,015,264 | 3/1977 | Koerner | 343/895 |
| 4,032,921 | 6/1977 | Sikina, Jr. et al. | 343/895 |
| 4,114,164 | 9/1978 | Greiser | 343/895 |
| 4,559,539 | 12/1985 | Markowitz et al. | 343/895 |
| 4,644,366 | 2/1987 | Scholz | 343/895 |

FOREIGN PATENT DOCUMENTS

| | | | |
|---|---|---|---|
| 0083901 | 5/1982 | Japan | 343/895 |
| 1294831 | 11/1972 | United Kingdom | 343/895 |

*Primary Examiner*—Michael C. Wimer
*Assistant Examiner*—Tan Ho
*Attorney, Agent, or Firm*—Kenyon & Kenyon

[57] ABSTRACT

A broadband antenna system including a frequency-dependent antenna and a frequency-independent antenna coupled to the frequency-dependent antenna. The antenna system can be arranged so that a dipole or monopole antenna is coupled to the inner or outer termination points of a spiral antenna. When the dipole antenna is coupled to the outer termination points of the spiral antenna, the elements of the spiral antenna may be extended.

9 Claims, 3 Drawing Sheets

ANTENNA SYSTEM INCLUDING SPIRAL ANTENNA AND DIPOLE OR MONOPOLE ANTENNA

This application is a continuation of application Ser. No. 07/645,585, filed on Jan. 24, 1991, now abandoned.

FIELD OF THE INVENTION

The present invention relates to an antenna system and in particular to a broadband antenna system.

BACKGROUND OF THE INVENTION

A problem with known antennas that operate in the frequency range of 50 MHz to 5,000 MHz, the range that includes UHF, VHF and FM reception, is that over at least a portion of this range they are not good receivers.

Typically, commercially available antennas that cover this range are of the frequency-dependent type, which includes, among others, monopole and dipole antennas. The most commonly used frequency-dependent antennas for VHF and FM reception are half-wave dipole antennas, commonly referred to as rabbit-ear antennas.

Frequency-dependent antennas operate over a limited frequency range. The antenna output and other parameters vary significantly as a function of frequency, so as to make it necessary to adjust the antenna in some manner at each frequency of interest to cover a broader range of frequencies. For example, a half-wave dipole antenna may be fully extended to receive low-frequency transmission (e.g., channel 2 television), and may be progressively shortened to receive higher frequencies/channels. Additionally, the antenna may need rotation about its vertical axis to ensure that the beam peak points in the general direction of signal transmission.

Consequently, frequency-dependent antennas need frequent adjustment as the frequency intended to be received varies. Users often ignore this need, which contributes to sub-optimal performance. Prior attempts to eliminate the need for frequent adjustment have resulted in an abundance of tuning requirements that have complicated operation to the degree where it is not only inconvenient to a user, but also nearly impossible to actually reach an optimum level of performance.

An additional problem with frequency-dependent antennas is that the gain is relatively low, on the order of 1 dB. The gain is often improved (i.e., signal reception is strengthened) through active signal amplification at the antenna output, but at the expense of an increase in system noise, which always occurs when pre-amplification is employed. This creates an additional need for DC power. Such an active system (i.e., one requiring DC power to operate) is more costly, more complicated, and more likely to break down.

Frequency-independent antennas, by contrast, require little or no adjustment throughout the entire range over which they operate because the antenna output and other parameters do not vary significantly as a function of frequency over the specified bandwidth of the antenna. Such antennas are especially attractive for broadband applications in instances where active signal amplification is not required. However, their limitation is that they must be very large to receive low-frequency transmissions, severely limiting their usefulness in a home environment. A relatively small stand alone frequency-independent antenna is not capable of effectively receiving signals in the low-frequency range.

An Archimedes spiral antenna, for instance, is a well-known type of frequency-independent, broadband antenna that requires no tuning over a wide range of frequencies. The antenna comprises at least one radiating element formed into a spiral in accordance with a predetermined mathematical formula. If the antenna comprises two or more radiating elements, the radiating elements are typically interleaved.

The rate of growth of a conductor is the rate at which the radiating elements spiral outwardly. The number of conductors and their rate of growth have a direct relationship to the frequency range to be covered by the antenna. In general, a signal is received at a portion of the spiral antenna having a circumference equal to the wavelength of the signal. The low frequency limit of a spiral antenna is defined as the frequency of a signal with a wavelength equal to the largest circumference of the spiral antenna. Therefore, to receive the long wavelengths of low-frequency transmission, the spiral must be quite large. For example, a spiral antenna used to receive channel 2 television transmissions would have to have a diameter of approximately 6 feet, and a circumference of approximately 19 feet. For obvious reasons, this size factor severely limits the usefulness of spiral antennas in a home environment.

A need therefore exists for an antenna that covers a broad range of frequencies with sufficient signal reception throughout the broad frequency range while having a streamline construction and providing ease of use.

SUMMARY OF THE INVENTION

The present invention provides an antenna system that covers a broad range of frequencies and provides strong signal reception throughout the frequency range. In particular, the antenna system of the present invention comprises a frequency-dependent antenna and a frequency-independent antenna coupled to the frequency-dependent antenna, to provide an antenna system that covers a broad range of frequencies while providing a signal strength greater than that of either a frequency-dependent or frequency-independent antenna alone. The antenna system of the present invention is capable of covering low frequencies while maintaining a relatively small size.

The antenna system of the present invention requires little if any active signal amplification. As a result, the antenna system is easy to construct and use. Furthermore, the antenna system requires only infrequent adjustment. Moreover, the antenna system is superior to a stand-alone frequency-dependent or frequency-independent antenna in that the antenna system is capable of linear polarization at any angle. Linear polarization is the receiving of only one of two orthogonal, directional components of a signal's electric field (the direction of the electric field being normal to the direction of the signal).

In an embodiment of the present invention, the frequency-independent antenna comprises an Archimedes spiral antenna with two outer and two inner termination points, and the frequency-dependent antenna comprises a half-wave dipole antenna, coupled to either the outer or inner termination points of the spiral antenna. However, any frequency-independent and frequency-dependent antennas may be used. The spiral antenna of this embodiment is basically circular in shape and spiralling outwardly. However, spiral antennas of any shape including, by way of example, elliptical, square, rectangular, and diamond-shaped spiral antennas may be used. The spiral antenna of this embodiment comprises two interleaved radiating elements although the principles of the present invention are applicable to any number of radiating elements. In this embodiment of the present invention, the frequency-dependent antenna is coupled to either the outer or the inner termination points of the spiral antenna, while two transmission lines are coupled to the opposite termination points.

When the frequency-dependent antenna is coupled to the outer termination points of the spiral antenna, each element of the spiral antenna may be extended some additional distance beyond the termination points. For example, if the antenna is circular-shaped, the elements may extend circumferentially beyond the termination points. These spiral extensions serve to enhance reception and broadbanding. In still other embodiments, a monopole antenna may be used as the frequency-dependent antenna.

DETAILED DESCRIPTION OF THE INVENTION

Figure 1:
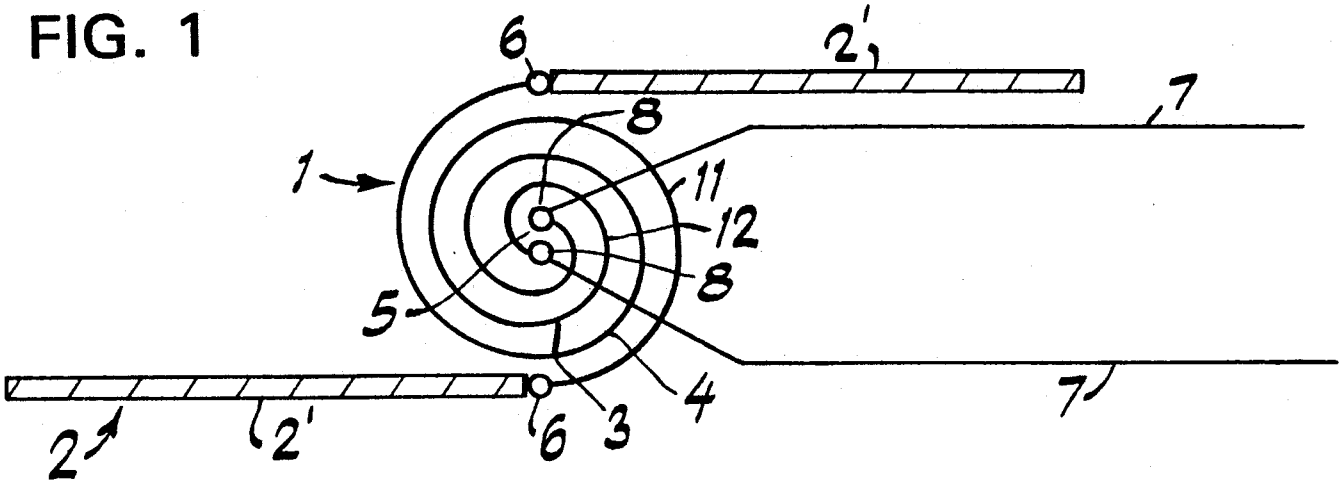
FIG. 1 is a top-plan view of a first embodiment of an antenna system of the present invention.

Referring now to FIG. 1, there is illustrated a first embodiment of an antenna system of the present invention. The antenna system comprises an Archimedes spiral antenna 1 and a half-Wave dipole antenna 2.

The spiral antenna 1 comprises two interleaved radiating elements 3 and 4. The radiating elements 3 and 4 may be constructed of any suitable conductive material including, by way of example, patterns etched on a PC board, wound wire, and sprayed conductive material on an insulating background.

The spiral antenna 1 is basically circular-shaped, although the principles of the present invention are applicable to spiral antennas of any shape.

The radiating elements 3 and 4 originate at a central portion 5 and spiral outwardly in a spiral path in a common plane about a common central axis to a selected radius. The radiating elements may spiral outwardly according to the formula r=ko, where r=radius from central portion, k=constant, and o=angle of radius. The low frequency limit of the antenna system may be that of the Archimedes spiral antenna 1, which is the frequency of a signal with a wavelength equal to the largest circumference of the spiral antenna 1.

Each of the two elements 2' of the half-wave dipole antenna 2 is coupled to the spiral antenna 1 at a corresponding one of the two outer termination points 6 of the spiral antenna 1.

Each of two transmission lines 7 is coupled to a receiver and to the spiral antenna 1 at a corresponding one of the two inner termination points s of the spiral antenna 1.

The antenna may, for example, comprise a flat, two-wire Archimedes spiral antenna with an 8" diameter coupled to a half-wave dipole antenna, commonly referred to as a rabbit-ear antenna, with approximately 37" long elements. The resulting antenna system covers a wide range of frequencies, i.e., the entire spectrum between 50 MHz and 5,000 MHz, and yet may be relatively small and require only infrequent adjustment. The antenna system yields consistently strong signal reception for UHF, VHF and FM frequencies, i.e., stronger than that of a stand-alone frequency-dependent or frequency-independent antenna. Furthermore, little if any active signal amplification is required and, as a result, the antenna system is easy to construct and use.

It is believed that attaching a dipole antenna 2 to the termination points of a spiral antenna 1 to form an antenna system extends the low-frequency capability of the spiral antenna 1 for linear polarization without adding appreciably to the volume. If it is attached so as to allow for 360° of rotation, linear polarization at any angle can be achieved because the dipole elements 2' can be positioned to any angle. The spiral antenna 1 adds electrical length to the dipole antenna 2, and acts as a broadband transmission line matching section, i.e., the spiral antenna 1 enhances receiving capability by producing a maximum signal at the transmission lines.

It is believed that at the VHF frequencies, channels 2 through 13, signal reception takes place partially at the dipole elements 2', and partially at the outer portion 11 of the spiral antenna 1 (i.e., the portion of the radiating elements 3 and 4 close to the outer termination points 6 of the spiral antenna 1). The inner portion 12 of the spiral antenna 1 (i.e., the portion of the radiating elements 3 and 4 close to the inner termination points 8 of the spiral antenna 1) acts mainly as a transmission line matching section.

With respect to the UHF frequencies, channels 14 through 82, it is believed that reception of lower frequency signals takes place mainly at the outer portion 11 of the spiral antenna 1. Reception of higher frequency signals takes place mainly at the inner portion 12 of the spiral antenna 1.

It is believed that the beamwidth (i.e., the number of degrees between the points where the power of a signal is one-half its maximum value) is approximately 80 degrees throughout the whole UHF frequency range. Received signals are cigar-shaped at right angles to the plane of the spiral antenna 1. The signals are circularly polarized in one direction on one side of the plane, and circularly polarized in the opposite direction on the other side of the plane (circular polarization is the receiving of two orthogonal, directional components of a signal's electric field).

Figure 2:
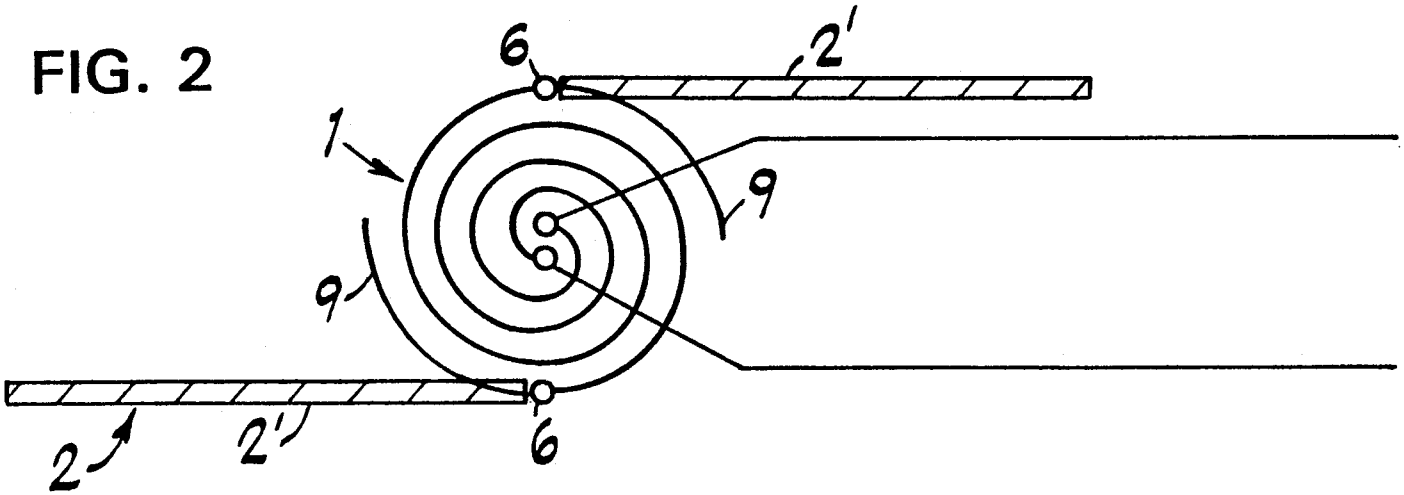
FIG. 2 is a top-plan view of a second embodiment of an antenna system of the present invention.

Referring now to FIG. 2, there is illustrated a second embodiment of the present invention. This antenna system is similar to the antenna system illustrated in FIG. 1, except that it further includes two spiral extensions 9, each of which continue beyond one of the two outer termination points 6 of the spiral antenna 1. The spiral extensions 9 extend approximately a quarter-turn beyond the outer termination points 6 to which the elements 2' of the dipole antenna 2 are connected. The spiral extensions 9 are similar in construction and method of winding to the rest of the spiral antenna 1. The spiral extensions 9 serve to enhance reception and broadbanding.

Figure 3:
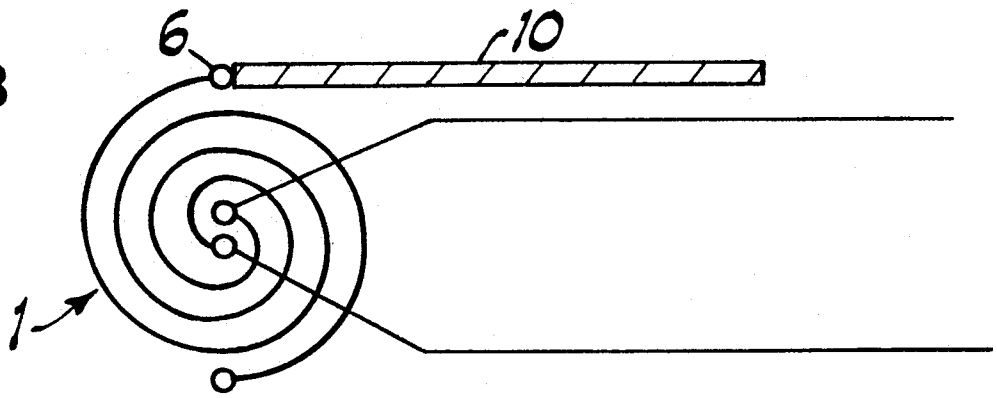
FIG. 3 is a top-plan view of a third embodiment of an antenna system of the present invention.

Referring now to FIG. 3, there is illustrated a third embodiment of the present invention. This antenna system is similar to the antenna system illustrated in FIG. 1, except that the dipole antenna is replaced by a monopole antenna 10, which is connected to the spiral antenna 1 at one of the outer termination points 6 of the spiral antenna 1.

The spiral antenna 1 acts as a broadband transmission line matching section and adds electrical length to the monopole antenna 10. Thus the spiral antenna 1 serves to minimize the negative effects typically associated with the removal of one of the elements of a stand-alone dipole antenna to create a monopole antenna.

Figure 4:
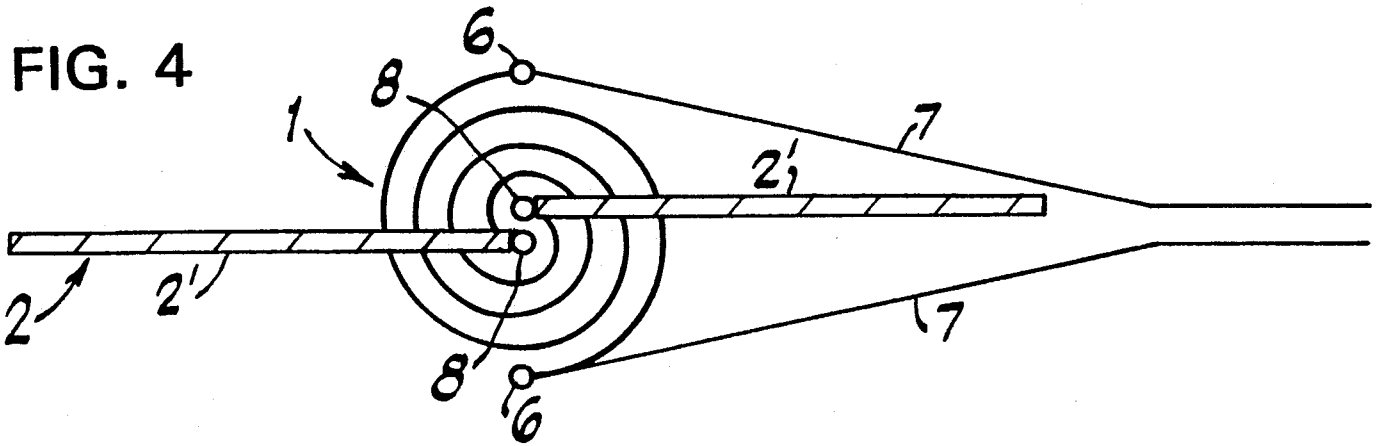
FIG. 4 is a top-plan view of a fourth embodiment of an antenna system of the present invention.

Referring now to FIG. 4, there is illustrated a fourth embodiment of the present invention. This antenna system is similar to the antenna system illustrated in FIG. 1, except that each of the two elements 2' of the dipole antenna 2 is connected to the spiral antenna 1 at one of the two inner termination points 8, rather than outer termination points 6 of the spiral antenna 1, while each of the two transmission lines 7 is connected to the spiral antenna 1 at one of the two outer termination points 6, rather than inner termination points 8 of the spiral antenna 1.

The performance of this antenna system is similar to the antenna system illustrated in FIG. 1, except that the direction of circular polarization of the signals is reversed.

Figure 5:
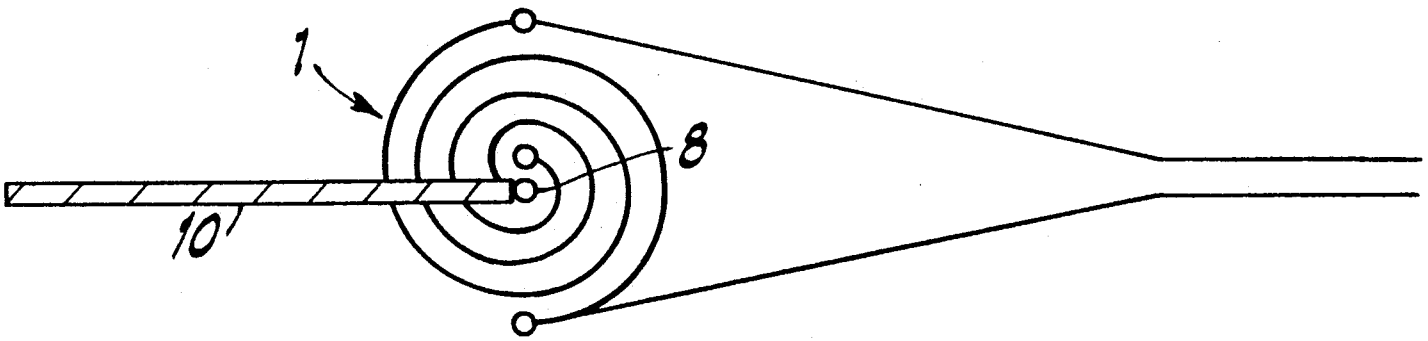
FIG. 5 is a top-plan view of a fifth embodiment of an antenna system of the present invention.

Referring now to FIG. 5, there is illustrated a fifth embodiment of the present invention. This antenna system is similar to the antenna system illustrated in FIG. 4, except that the dipole antenna is replaced by a monopole antenna 10, which is connected to the spiral antenna 1 at one of the inner termination points 8 of the spiral antenna 1.

As is the case with the antenna system illustrated in FIG. 3, ease of use, simplicity of construction and dependability are improved, while the negative effects of removing one of the elements of the dipole antenna are minimized.

What is claimed is:

1. An antenna system for receiving transmitted signals, comprising:

a spiral antenna including two interleaved radiating elements, said radiating elements each originating at an inner termination point of said spiral antenna and spiralling outwardly in a spiral path to an outer termination point of said spiral antenna;

a dipole antenna including two elements, each of said elements of said dipole antenna being coupled to a corresponding one of said outer termination points of said spiral antenna;

wherein said spiral antenna further includes spiral extensions disposed along a spiral curve defined by said spiral antenna, connected to and continuing beyond said outer termination points of said spiral antenna.

2. An antenna system according to claim 1 wherein said dipole antenna is a half-wave dipole antenna.

3. An antenna system according to claim 2 wherein said spiral antenna is an Archimedes spiral antenna.

4. An antenna system according to claim 3, further comprising transmission lines coupled to said Archimedes spiral antenna at said inner termination points.

5. An antenna system according to claim 1 wherein said spiral extensions extend approximately a quarter-turn beyond said outer termination points of said spiral antenna.

6. An antenna system according to claim 5 wherein said dipole antenna is a half-wave dipole antenna.

7. An antenna system according to claim 6 wherein said spiral antenna is an Archimedes spiral antenna.

8. An antenna system according to claim 7, further comprising transmission lines coupled to said Archimedes spiral antenna at said inner termination points.

9. An antenna system according to claim 1 wherein the antenna system operates in a frequency range of 50 MHz to 5,000 MHz.

* * * * *